United States Patent [19]

Insley et al.

[11] Patent Number: 4,972,945

[45] Date of Patent: Nov. 27, 1990

[54] CONTAINER FOR TRANSPORTING HAZARDOUS LIQUIDS

[75] Inventors: Thomas I. Insley; Laurel A. Alvarez, both of St. Paul, Minn.

[73] Assignee: Minnesota Mining and Manufacturing Company, St. Paul, Minn.

[21] Appl. No.: 521,999

[22] Filed: May 11, 1990

[51] Int. Cl.[5] ..... B65D 81/26

[52] U.S. Cl. ..... 206/204; 206/524.3; 206/524.5

[58] Field of Search ..... 220/404, 410; 206/204, 206/524.3, 524.4, 524.5

[56] References Cited

U.S. PATENT DOCUMENTS 4,379,455 4/1983 Deaton ..... 220/404
4,724,955 2/1988 Martin et al. ..... 206/204
4,783,206 11/1988 Cullen et al. ..... 206/204
4,865,855 9/1989 Hansen et al. ..... 206/204

*Primary Examiner*—Joseph M. Moy
*Attorney, Agent, or Firm*—Donald M. Sell; Walter N. Kirn; David W. Anderson

[57] ABSTRACT

A container for transporting hazardous liquids has a self-sustaining, leak-proof housing, a removable cover that can seal the housing, and a sorbent body resting on the flat bottom of the housing, which body comprises polyolefin microfibers and has a solidity of from 7 to 25%. The polyolefin microfibers preferably are particles, and the particles preferably are microwebs produced by divellicating a polyolefin microfiber web. When the container is used to transport sorbent materials that have been saturated by liquids of a chemical spill, the sorbent body ensures against there being any free liquid in the container.

16 Claims, 1 Drawing Sheet

CONTAINER FOR TRANSPORTING HAZARDOUS LIQUIDS

BACKGROUND OF THE INVENTION

1. Field of the Invention

The invention concerns a container for transporting and storing liquids that are possibly hazardous. More specifically, the invention is concerned with preventing such liquids from leaking into the environment.

2. Description of the Related Art

The invention is primarily concerned with the need to transport safely hazardous liquids, e.g. liquids recovered from chemical spills.

Liquids from chemical spills typically are picked up by sorbent materials, e.g. POWERSORB TM liquid-sorbing pillows, pads, and booms from 3M, the company to which this application is assigned. The liquid-saturated sorbent materials are then transported in unbreakable, leak-proof drums of several sizes, each of which is large enough to hold a number of saturated sorbent articles. Even though the drum is designed to be unbreakable and is sealed, U.S. Federal regulation 49 CFR 173.3 (c) (2) states: "Each drum must be provided with . . . sufficient cushioning and absorption material to prevent excessive movement of the damaged package and to absorb all free liquid."

Free liquid collects in the bottom of a drum principally as the result of compression, and subsequent desorbtion of liquid from saturated sorbent articles in the lower portion of the drum. Haphazard practices are currently used to deal with free liquids in shipping drums. Chopped corn cobs or similar sorbent materials are sometimes added to the loaded drums in an attempt to take up any free liquid.

SUMMARY OF THE INVENTION

The invention provides a container which is believed to be the first by which sorbent materials saturated with hazardous liquids can be economically transported while meeting the requirements of the above-cited 49 CFR 173.3 (c) (2). The term "hazardous" can be applied to any liquid which might damage the environment, whether or not the liquid is classified as hazardous.

Briefly, the container of the invention comprises

- a self-sustaining, leak-proof housing defining a reservoir,
- a removable cover that provides a liquid-tight seal across the top of the reservoir, and
- a sorbent body on the bottom of the reservoir, which body comprises polyolefin microfibers and has a solidity of up to 25%.

By the "bottom" of the reservoir is meant the portion of the reservoir that is most remote from the lip of the reservoir. The bottom preferably is broad and flat to afford stability during storage and shipment.

The sorbent body preferably is produced by compressing particles of polyolefin microfibers. The term "articles of polyolefin microfibers" includes (1) microwebs produced by divellicating a polyolefin microfiber web as disclosed in U.S. Pat. No. 4,813,948 (Insley), which is incorporated herein by reference, (2) particles obtained by hammer milling a polyolefin microfiber web, and (3) flash spun polyolefin microfibers, such as Tywick TM hazardous material pulp available from New Pig Corp., Altoona, Pa. which have a diameter of about 1 to 5 μm and an average particle length of 1 to 6 mm. The best sorbency for a given solidity is obtained when those particles are polyolefin microfiber microwebs.

Alternatively, the sorbent body can be produced by compressing polyolefin microfiber webs such as the webs described in Wente, Van A., "Superfine Thermoplastic Fibers," Industrial Engineering Chemistry, vol. 48, pp. 1342–1346, and in Wente, Van A. et al., "Manufacture of Superfine Organic Fibers," Report No. 4364 of the Naval Research Laboratories, published May 25, 1954.

As taught in the Insley U.S. Pat. No. 4,813,948, particles of polyolefin microfibers from which the sorbent body is made can be loaded with particulate material. The particulate material can be a sorbent-type material or a material selected to neutralize potentially hazardous liquids. For example, see U.S. Pat. No. 3,971,373 (Braun), U.S. Pat. No. 4,100,324 (Anderson et al.) and U.S. Pat. No. 4,429,001 (Kolpin et al.), which are incorporated herein by reference.

The solidity of the sorbent body is calculated according to the formula $$\% \text{ solidity} = \frac{\text{density of sorbent body}}{\Sigma(\text{comp. dens.} \times \text{wt. fract. of comp.})} \times 100$$

where "comp. dens." is the density of the individual components present in the sorbent body and "wt. fract. of comp." is the corresponding weight fraction of the component.

While greater sorbency is achieved at lower solidities, a sorbent body of higher solidity has greater coherency. If the solidity were substantially greater than 25%, the capacity of the sorbent body would be unduly reduced. Preferably the solidity is at least 7%, otherwise the sorbent body would tend to have insufficient integrity to remain intact while being handled or shipped, both before use and while being used to transport hazardous liquids.

While the solidity of the sorbent body can be as low as 7%, its solidity preferably should be at least 12%, because sorbent bodies having solidities substantially less than about 12% shrink when saturated with liquid, thereby increasing their "effective" solidity to about 10–12%. Hence, an unsaturated sorbent body having a solidity of less than 12% necessarily occupies a greater volume percentage of the container than does a sorbent body of higher solidity that would sorb an equivalent quantity of liquid. This would reduce the number of saturated sorbent articles that could be placed in the container.

The solidity of the sorbent body should be selected such that the thickness of the sorbent body is not substantially reduced or compressed under the weight of saturated sorbent articles to be loaded into the container. Typically, this level of compression resistance is attained when the solidity of the sorbent body is from 12 to 20%. Another factor to be taken into account is that sorbent bodies having higher solidities have better coherency and consequently can tolerate more abuse than sorbent bodies of lower solidity. The sorbent bodies of the invention reflect a compromise between the resistance to compression under expected loads, sorbency requirements, and integrity or strength requirements.

The volume of the container that is occupied by the sorbent body should be kept to a minimum while being large enough to sorb the anticipated volume of liquid that may be desorbed from saturated sorbent articles loaded into the container. This can generally be accomplished when the sorbent body occupies less than 35% of the container volume. In most cases, the sorbent body should occupy from 5 to 25% of the container volume.

The leak-proof housing and the cover of the novel container preferably comprise a high-impact, thermoplastic resin that is chemically resistant to aggressive chemicals, has good stress crack resistance, and retains good toughness at temperatures as low as −30° C. A preferred thermoplastic resin having these properties is polyethylene. For greater strength, the resin can be filled with reinforcing materials such as glass fibers or the housing and cover can comprise metal.

The sorbent body preferably completely covers the bottom of the reservoir. It can also extend along the sides of the reservoir, there sorbing free liquids that might not be completely sorbed by the portion covering the bottom of the reservoir. However, because the sorbent body of the container of the invention has limited structural integrity, surfaces that may be subjected to abrasion are advantageously covered by a tough, porous material such as spun-bonded polypropylene scrim.

Compression of the particles of polyolefin microfibers can be accomplished at ambient temperatures using conventional compression molding equipment such as flash molding or powder molding equipment. Generally, pressures in the range of about 0.5 to 3 MPa are sufficient to achieve the desired degree of solidity. When the particles are microfiber microwebs, pressures in the range of about 0.7 to 2.0 MPa should be sufficient to produce sorbent bodies in the preferred solidity range of about 12 to 20%. At such pressures sorbent bodies of good integrity are obtained with no significant reduction in the available microfiber surface area.

BRIEF DESCRIPTION OF THE DRAWING

The invention may be more easily understood in reference to the drawing, in which.

DESCRIPTION OF THE PREFERRED EMBODIMENTS

Figure 1:
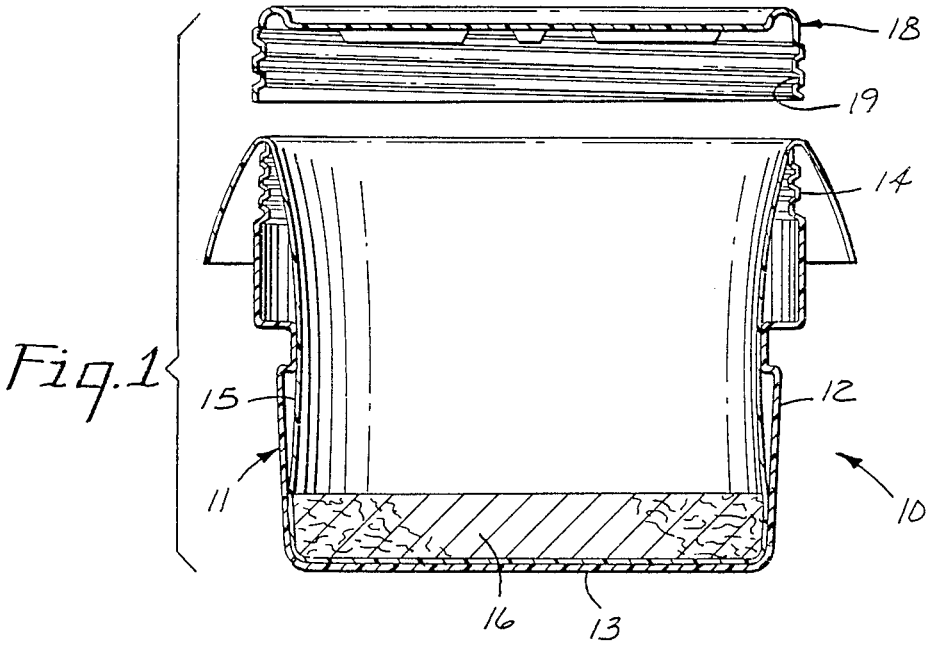
FIG. 1 is a schematic central cross section through a container of the invention.

The container 10 of FIG. 1 has a leak-proof resinous housing 11 with a substantially cylindrical wall 12 that creates a cupped reservoir having a flat bottom 13. The lip of the wall has been formed with male threads 14. The reservoir has been lined with a flexible plastic bag 15 that protrudes sufficiently to permit the bag to be tied shut after being filled with saturated sorbent articles. Covering the flat bottom of the reservoir is a sorbent body 16 that has been produced by pouring particles of polyolefin microfibers into the bag 15 and then compressing the particles into a coherent mass.

After filling the reservoir with a number of unused sorbent articles such as pillows (not shown), a resinous cover 18 that has female threads 19 can be screwed onto the housing. With the cover in place, the container can be shipped to the site of a chemical spill and there opened to provide convenient access to its sorbent articles which are returned to the housing after being saturated with the spilled liquids. The bag 15 is then tied, and the container is sealed by screwing on the cover to permit the container to be transported to a disposal site.

Figure 2:
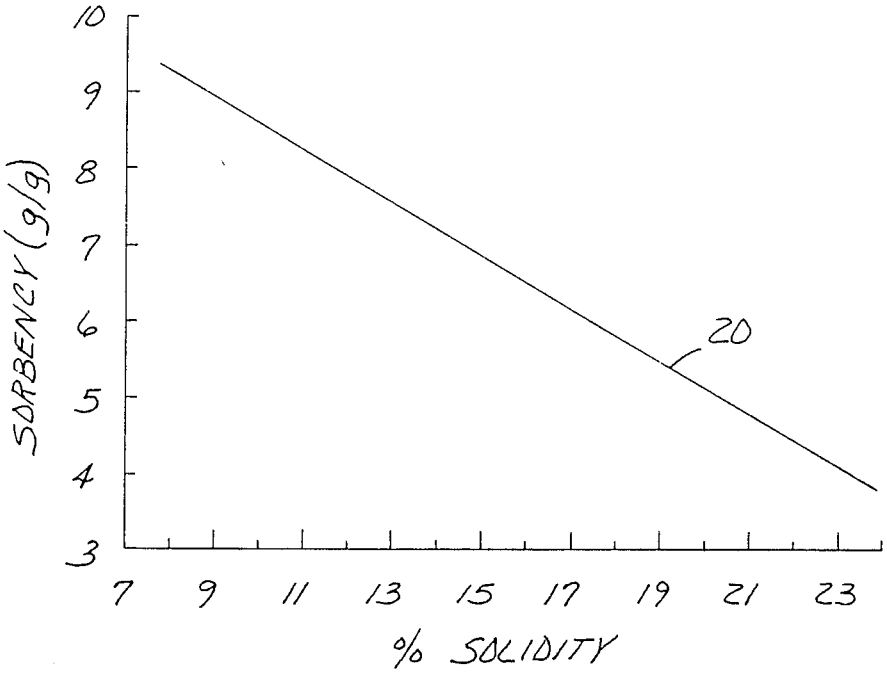
FIG. 2 is a graph of sorbency vs. solidity for sorbent bodies useful in the invention.

FIG. 2 is discussed in connection with Examples 2–12.

TEST PROCEDURE

Sorbency

A plug of molded microweb material, 100 gm in weight, 14.5 cm in diameter, and having the indicated solidity, is placed in a container of water and allowed to soak for 15 minutes. The sample is then removed and allowed to drain for 15 minutes, and the sorbency of the plug is determined by weight differential. "Sorbency" is reported in grams of liquid retained per gram of absorbent.

EXAMPLES

Microfiber Source Web

A polypropylene blown microfiber BMF) source web was prepared according to U.S. Pat. No. 4,933,229 (Insley et. al.), which is incorporated herein by reference. The microfiber web had an average fiber diameter of 6–8 μm (effective), a basis weight of 270 gm/m$^2$, a solidity of 5.75%, and contained 8% by weight "Triton X-100", a poly(ethylene oxide) based nonionic surfactant available from Rohm and Haas Corp.

Microfiber Microwebs A

The "Microfiber Source Web" was divellicated as described in U.S. Pat. No. 4,813,948 (Insley), using a lickerin having a tooth density of 6.2 teeth/cm$^2$ and a speed of 1200 rpm to produce "Microfiber Microwebs A" having an average nuclei diameter of 0.5 mm, an average microweb diameter of 1.3 mm, and a solidity of about 2%.

EXAMPLE 1

Approximately 4.55 kg of "Microfiber Microwebs A" were placed in a 75.7 liter (20 gal) rated capacity polyethylene salvage drum (45.7 cm in diameter), the drum was placed in a hydraulic press, and the microfiber microwebs were subjected to a compression pressure of 0.70 MPa to form a sorbent body in the bottom of the container. The average thickness of the sorbent body after the drum was removed from the press was about 14.6 cm (5.75 inches) which corresponded to an average solidity of 18.85%. (The sorbent body was bowed toward the center of the drum resulting in a slight increase in the measured thickness of the central portions of the body relative to its edges). An assortment of POWERSORB TM sorbent articles (1 P208 Minibooms—7.6 cm diameter × 244 cm length, 15 P 110 Pads—28 cm × 33 cm and 12 P300 Pillows—23 cm × 38 cm, from 3M Co.) which had been previously saturated with water were then placed in the drum to fill it to capacity. The sorbent articles were displaced slightly so as to allow visual inspection of the bottom of the drum immediately after loading the saturated sorbent articles and again after the drum had been capped and allowed to stand at ambient conditions for approximately 20 hours. At both inspections, no free liquid was observed in the drum.

COMPARATIVE EXAMPLE

A drum identical to that used in Example 1, except that its bottom did not contain a sorbent body, was loaded with the same number and types of saturated sorbent articles as in Example 1. Inspection of the drum for free liquid immediately after the saturated articles were loaded into the drum revealed free liquid, of a depth of approximately 13 cm, surrounding the sorbent articles resting on the bottom of the drum. A similar examination after the drum had been capped and allowed to stand at ambient conditions for 20 hours revealed no significant change in the depth of free liquid.

EXAMPLES 2–12

100 gm of "Microfiber Microwebs A" were placed in a 14.5 cm diameter (ID) cylindrical mold and compressed under the indicated pressure to produce a plug having the indicated thickness as shown in Table I in a process similar to that of Example 1. After removal from the mold, the sorbency of each plug was determined using the previously described Sorbency Test.

TABLE I

| | COMPRESSION PARAMETERS | | |
|---|---|---|---|
| Example | Microweb Weight (gm) | Compressed Thickness (cm) | Applied Press. (MPa) |
| 2 | 100 | 5.0 | — |
| 3 | 100 | 3.0 | — |
| 4 | 100 | 3.5 | — |
| 5 | 100 | 2.0 | 0.70 |
| 6 | 100 | 1.8 | 0.98 |
| 7 | 100 | 1.7 | 0.88 |
| 8 | 100 | 1.8 | 0.88 |
| 9 | 100 | 1.5 | 1.40 |
| 10 | 100 | 1.4 | 1.75 |
| 11 | 100 | 2.0 | 0.70 |
| 12 | 100 | 1.8 | 1.05 |

TABLE II

| | SORBENCY | | | |
|---|---|---|---|---|
| Example | Recovered Thickness (cm) | Sat. Weight (gm) | Solidity (%) | Sorbency (gm/gm) |
| 2 | 9.0 | 1045 | 8 | 9.5 |
| 3 | 7.3 | 980 | 10 | 8.8 |
| 4 | 7.2 | 970 | 10 | 8.7 |
| 5 | 5.3 | 845 | 13 | 7.5 |
| 6 | 4.0 | 670 | 17 | 5.7 |
| 7 | 4.0 | 690 | 17 | 5.9 |
| 8 | 4.0 | 705 | 17 | 6.1 |
| 9 | 3.2 | 570 | 22 | 4.7 |
| 10 | 2.9 | 490 | 24 | 3.9 |
| 11 | 5.7 | — | 12 | — |
| 12 | 4.0 | — | 17 | — |

Linear regression of the data of Table II produced curve 20 of FIG. 2, which demonstrates a direct correlation between the sorbency of the compressed plugs and their solidity, namely, the lower the solidity, the higher the sorbency.

It should also be noted that the sorbent body of Example 1, which was confined in a drum during testing, has a higher solidity than the plugs of Examples 5 and 11 which were compressed under similar pressures but were not confined during testing. Confinement, such as by the drum used in Example 1, can apparently limit post-compression relaxation of the compressed microfiber body. The solidity of confined compressed microfiber bodies can be as much as 50% higher than the solidity of identical microfiber bodies that are not confined.

What is claimed is:

1. A container suitable for transporting hazardous liquids, said container comprising a self-sustaining, leak-proof housing defining a reservoir, a removable cover that provides a liquid-tight seal across the top of the reservoir, and a sorbent body on the bottom of the reservoir, which body comprises polyolefin microfibers and has a solidity of up to 25%.

2. A container as defined in claim 1 wherein the polyolefin microfibers comprise particles of polyolefin microfibers.

3. A container as defined in claim 1 wherein the sorbent body has a solidity of at least 7%.

4. A container as defined in claim 3 wherein the sorbent body has a solidity of at least 12% but less than 20%.

5. A container as defined in claim 1 wherein the sorbent body occupies up to 35% of the volume of the reservoir.

6. A container as defined in claim 1 wherein said sorbent body occupies from 5 to 25% of the volume of the reservoir.

7. A container as defined in claim 1 wherein the bottom of the reservoir is broad and flat to afford stability during storage and shipment.

8. A container as defined in claim 5 wherein said sorbent body also extends along the sides of the reservoir.

9. A container as defined in claim 6 wherein the sorbent body completely covers the bottom of the reservoir.

10. A container as defined in claim 1 wherein said particles of polyolefin microfibers comprise microwebs.

11. A container as defined in claim 1 wherein the sorbent body is loaded with solid sorbent-type particulate material.

12. A container as defined in claim 1 wherein said sorbent body is loaded with material selected to neutralize potentially hazardous liquids.

13. A container as defined in claim 1 wherein said housing and cover are high-impact thermoplastic resin that is chemically resistant, has good stress crack resistance, and retains good toughness at temperatures as low as −30° C.

14. A container as defined in claim 13 wherein said housing and cover are polyethylene.

15. A container suitable for transporting hazardous liquids, said container comprising a self-sustaining, leak-proof resinous housing which has a substantially cylindrical wall, a broad, flat bottom, closing one end of the housing to create a reservoir, and male threads formed in the wall opposite the bottom, a flexible plastic bag lining the reservoir and protruding sufficiently to permit the bag to be tied shut after being filled, a sorbent body of compressed polyolefin microfiber microwebs located inside the bag and completely covering the flat bottom of the reservoir, which sorbent body has a solidity of at least 12% but less than 20% and occupies from 5 to 25% of the volume of the reservoir, and a resinous cover that has female threads by which it can be screwed onto the housing to seal the container.

16. A container as defined in claim 15 wherein said housing and cover are polyethylene.

* * * * *